United States Patent [19]

Zelina, Jr.

[11] Patent Number: 4,605,993

[45] Date of Patent: Aug. 12, 1986

[54] RECHARGING SPOT/FLOOD LANTERN

[75] Inventor: Francis J. Zelina, Jr., Lake City, Pa.

[73] Assignee: Lighting Systems, Inc., Erie, Pa.

[21] Appl. No.: 683,343

[22] Filed: Dec. 19, 1984

[51] Int. Cl.[4] ..... F21L 7/00

[52] U.S. Cl. ..... 362/183; 362/184; 362/191; 362/200

[58] Field of Search ..... 362/183, 184, 190, 191, 362/200, 227, 362

[56] References Cited

U.S. PATENT DOCUMENTS

| | | | |
|---|---|---|---|
| 2,980,889 | 4/1961 | Meissner | 362/184 X |
| 3,829,676 | 8/1974 | Nelson et al. | 362/183 |
| 4,029,954 | 6/1977 | Moyer | 362/183 |
| 4,171,534 | 10/1979 | Strowe | 362/183 |
| 4,181,928 | 1/1980 | Zelina | 362/184 |
| 4,325,107 | 4/1982 | MacLeod | 362/183 |

*Primary Examiner*—Willis R. Wolfe, Jr.
*Attorney, Agent, or Firm*—Charles L. Lovercheck; Wayne L. Lovercheck; Dale R. Lovercheck

[57] ABSTRACT

A battery operated lamp and battery charger are disclosed. The lamp is equipped with a rechargeable battery and a battery charger stand. The lamp has a lamp support surface with a center terminal, and a second terminal spaced from the center which engages the center terminal and second terminal respectively on the lamp. Thus the two lamp terminals will engage the two respective charge terminals regardless of the position of orientation in which the lamp is placed on the charger. The charger circuit is powered from a power cord connected to a power line through a transformer a full wave rectifier to charging lines. These diodes and a switch are connected in parallel with two diodes. The lamp battery to be charged is connected in parallel with the charging lines. Thus, with the switch closed, the charging voltage is reduced to desired value by a voltage drop caused by the resistor and the three diodes in parallel with the battery. When the battery plates have become "sulfated" due to a complete discharge of the battery, the switch may be opened to give a higher "restore" voltage. A (LED) pilot light is connected through a resistor in parallel with the charging circuit. The pilot light indicates whether the power is on and/or whether the lamp is being charged. Wall mounting lugs are provided on the charger base so that the charger may be conveniently mounted on a wall or other vertical support.

9 Claims, 14 Drawing Figures

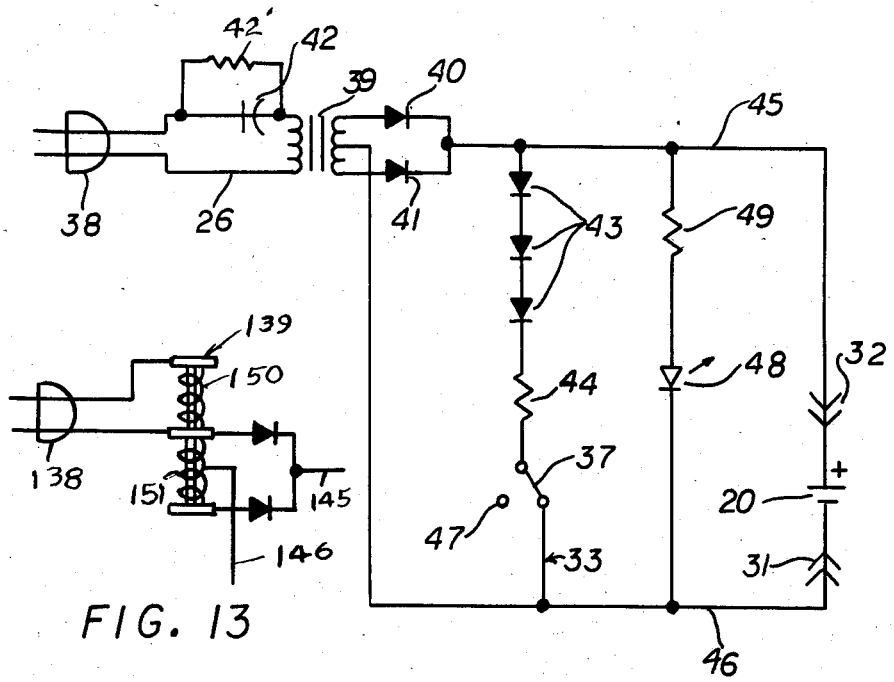
FIG. 13
FIG. 11
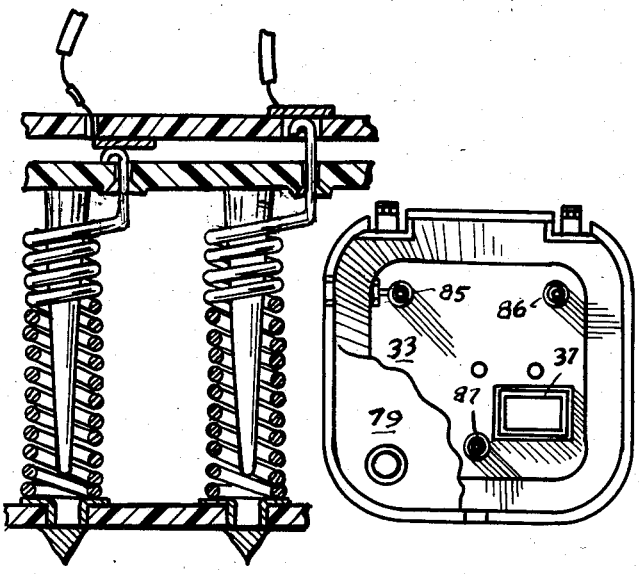
FIG. 14
FIG. 12

RECHARGING SPOT/FLOOD LANTERN

The following disclosure contains a correct and full desciption of the invention and of the best mode known to the inventor of taking advantage of the same.

BACKGROUND OF INVENTION

Prior battery charges for rechargeable flashlight batteries have been inconvenient to connect to the batteries for the recharging operation and have not had an effective indicator to show that the battery is connected to the charger or that the battery is taking the charge. The light and battery charger disclosed overcomes the prior problems with lights and chargers. The light is suitable for use as a utility light, for use during power failure, as a sport light and as a travel light. The light can be supported on the charger in any position of orientation. The charger has an electrical terminal point at its center which can engage the central terminal on a light or other device and a second terminal point spaced from the center terminal. The light has a terminal point at its center to made contact with the center terminal on the charger and an annular terminal spaced from and concentric to the center terminal so that the terminals of the bettery charger will connect the battery circuit regardless of the position to which the light is rotated with respect to the charger.

STATEMENT OF INVENTION

The present invention provides a combination lamp and rechargeable battery with a battery charger. The light can be supported on the charger stand in any position of orientation, and a pilot light on the charger stand indicates when the power is turned on and when the lamp battery is connected to the charger. When the lamp is resting on the charger, a pilot light provides a convenient means by which the user may locate the lamp even in the dark. The wall-mounted lugs on the charger stand make it possible for the charger and the light to be stored in a convenient location. When the lamp is placed on the charging stand, it is automatically connected to the charger circuit and it self charges continuously so that it is always ready to be used when needed.

The lamp provides a powerful spot beam, as well as a wide angle flood light. There are no batteries to replace. The light uses maintenance free sealed lead batteries which can be re-charged a minimum of 200 cycles from deeply discharge to 2000 cycles when used 30–45 minutes. The charging stand continuously charges the flashlight when the light is placed on it maintaining the batteries at the proper level of charge. The charger can be switched to a restoration mode whre it is used to charge deep discharged batteries that are sulfated and normally will not charge.

OBJECTS OF THE INVENTION

It is an object of the invention is to provide an improved combination battery operated lamp and bettery charger.

Another object is to provide an improved battery charger.

Another object of the invention is to provide a battery charger and a battery operated lamp that is simple in construction, economical to manufacture and simple and efficient to use.

Another object of the invention is to provide a lamp and charger with a pilot light to indicate when power is on, when light is on charge and power is off and as a lamp locater.

With the above and other objects in view, the present invention consists of the combination and arrangement of parts hereinafter more fully described, illustrated in the accompanying drawing and more particularly pointed out in the appended claims, it being understood that changes may be made in the form size, proportions and minor details of construction without departing from the spirit or sacrificing any of the advantages of the invention.

REFERENCE TO PRIOR ART

Applicant is aware of no prior art that discloses a battery charger like the one disclosed herein.

BRIEF DESCRIPTION OF DRAWING

FIG. 11 is a schematic electrical diagram of the battery charger.

FIG. 12 is a top view of the charger stand with part of the bottom removed and circuit board exposed.

FIG. 13 is a partial view of another embodiment of the circuit board.

FIG. 14 is an enlarged view of the charger and light.

DETAILED DESCRIPTION OF DRAWING

Figure 1:
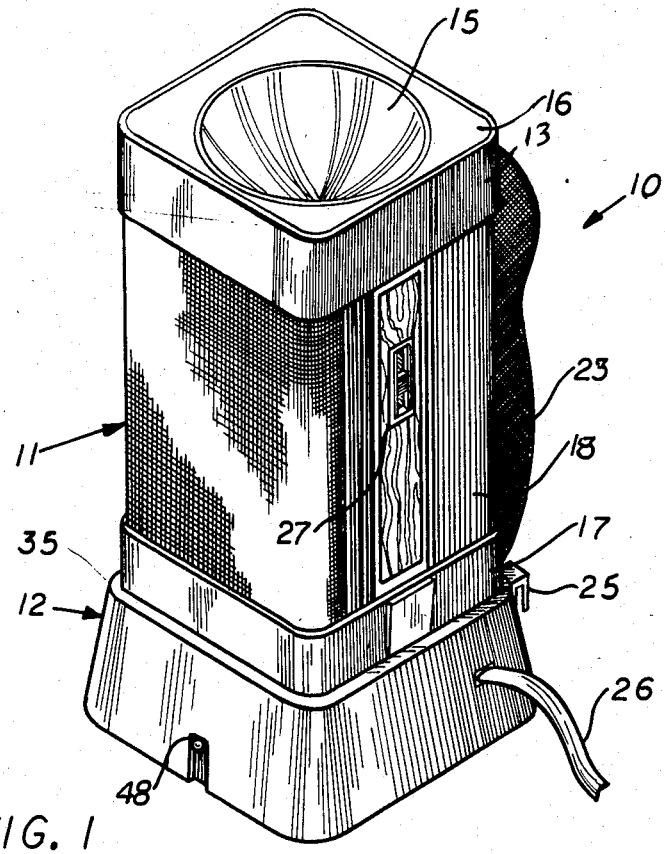
FIG. 1 is an isometric view of a light according to the invention supported on the battery charger.
Figure 2:
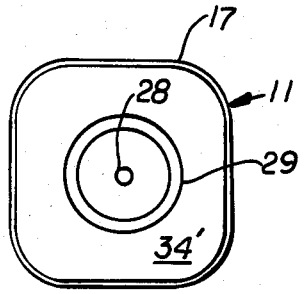
FIG. 2 is a bottom view of the light.
Figure 3:
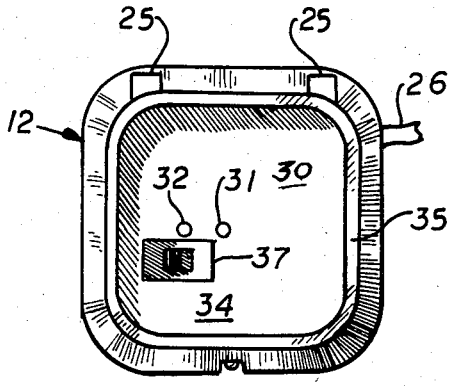
FIG. 3 is a top view of the battery charger.
Figure 4:
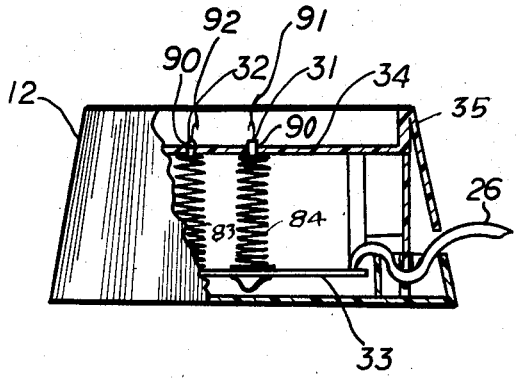
FIG. 4 is a side view partly in cross section of the battery charger.
Figure 5:
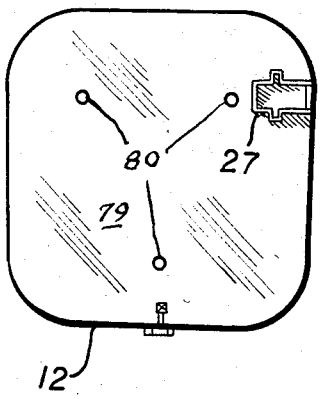
FIG. 5 is a bottom view of the battery charger.
Figure 6:
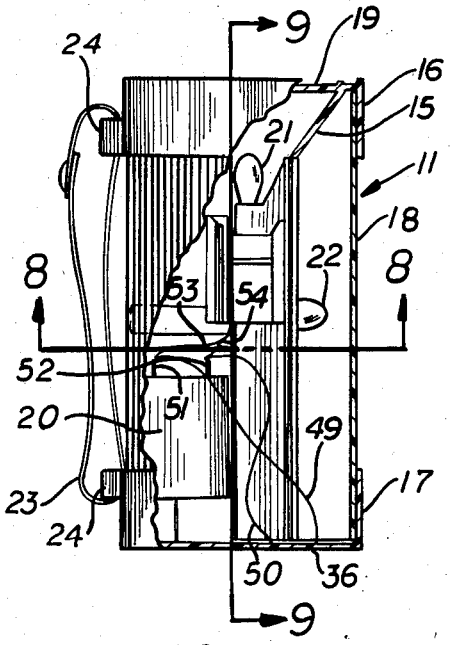
FIG. 6 is a side view partly in cross section of the light.
Figure 7:
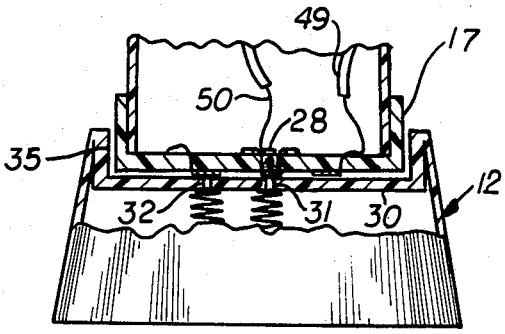
FIG. 7 is a side partial view partly in cross section of the light supported on the battery charger.
Figure 8:
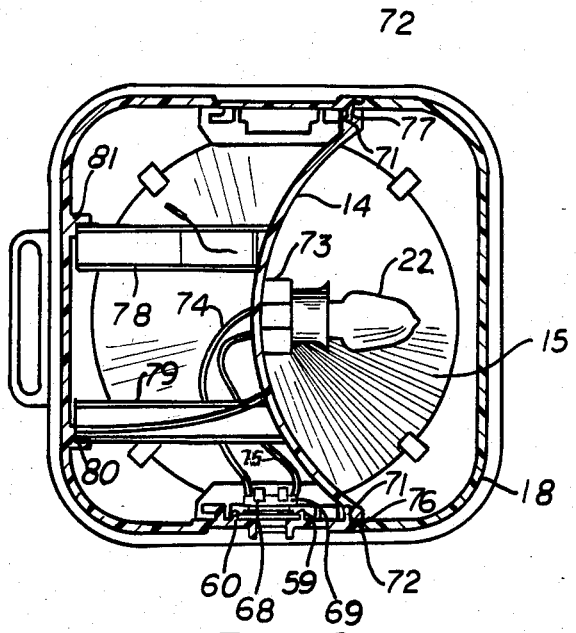
FIG. 8 is a cross sectional view taken on line 8—8 of FIG. 6.
Figure 9:
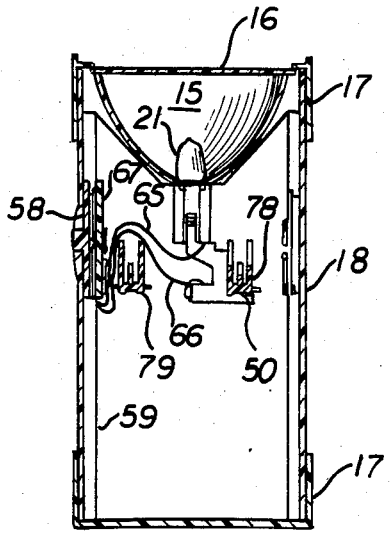
FIG. 9 is a longitudinal cross sectional view taken on line 9—9 of FIG. 6.
Figure 10:
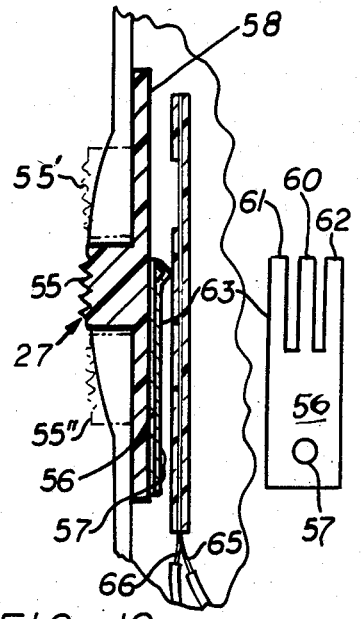
FIG. 10 is an enlarged cross sectional view of a part of FIG. 9.

Now with more particular reference to the drawings. The drawings show a combination 10 of the light having a case 11 and charger having a stand 12. The light has a flood reflector 14, with an end or spotlight reflector 15, with the end reflector supported on the case by an end reflector support 13 and an end lens 16. A bottom closure 17 is provided for the bottom of the light. The light has a side lens 18 and an end lens 16. The battery 20 is connected to the spot lamp 21 and the flood lamp 22 by means of a switch 27 and wires 65 and 66. A carrying strap 23 is connected to the case 11 by means of the strap lugs 24. The charger stand 12 is provided with hanger lugs 25 by means of which the stand may be supported conveniently on a wall. A charging cord 26 is connected to the charging circuit 34 supported on circuit board 35 and a switch 37 is supported on the circuit and extends through an opening in the top of the charger for chaning the output voltage of the charger to a higher voltage for initiating the charge of a sulfated battery or to a normal charge position, shown in FIG. 11, which provides a lesser voltage where a float charge is required. The bottom surface 36 of the bottom closure 17 of the light has a first charging terminal 28 at the center, and an annular second charge terminal 29 which are connected to the terminals on the battery by wires 49 and 50.

The battery rests against a piece of foam plastic 21' having pressure sensative adhesive on both sides whereby the battery is held in place to the flood reflector.

The charger stand 12 is provided with a top 30 which provides a supporting means for the bottom closure 17 of the light 10. A first charger terminal 31 and a second charger terminal 32 are slidably received in the top 30 and extend through top surface 34 of the top 30 of the stand. The charging circuit is supported on a circuit board 33 in the stand 12. The charger support stand 12 has a rim 35 which extends up from the top 30 and guides the end closure 17 of the light into position for charging, on top 30 of the charger 12.

The charger circuit 33 is indicated in FIG. 11. The charger circuit has a plug 38 connected to the power cord 26, and the transformer 39 connects the power cord 26 to the charging circuit through the full wave rectifier diodes 40 and 41. A condenser 42 is provided to protect the line from short circuits and the like. Resistor 42' is connected in parallel with condenser 42 to protect the circuit.

As an alternative, a spaced primary winding and secondary can be used as shown in FIG. 13 wherein primary winding 142' is spaced from secondary winding 142 on case 143. This transformer provides sufficient impedence to protect against short circuits.

A circuit to provide restore voltage for giving a higher output at the battery terminals to re-charge sulfated batteries is provided. The normal circuit is made up of the series connected diodes 43 in turn connected in series with the resistor 44 and the switch 37. Thus when the switch 37 is in the normal charging position shown, the diodes 43 and resistor 44 are connected in parallel with the lines 45 and 46, for reducing the voltage at the terminals 31 and 32 when the switch 37 is in the normal position shown. When the switch 37 is moved to the restore position 47, the voltage at the terminal 31 and 32 will be higher to remedy a possible sulfated condition of the battery. The pilot indicator light 48 which is a LED connected through the resistor 49 in parallel with lines 45 and 46. LED 48 will indicate when the plug 38 is connected to a live circuit and when the lamp is supported on the terminals 31 and 32 of the charger stand 12. Terminals formed by eyelets 92 and 93 which extend through circuit board 32 and engage the lower ends of springs 83 and 84. Springs 83 and 84 have hooks formed on their upper ends which prevent the springs from falling out of board 30 during assembly. Numerals 31 and 32 slide freely in holes 90 and 91 in top 30. Eyelets 92 and 93 are soldered to the circuit at 94 and 95. Eyelets 92 and 93 have heads that rest on the top of board 33 and support the lower ends of spring 83 and 84. Posts 96 and 97 are integrally attached to top 30 and extend downward and are received in helical springs 83 and 84. They hold spring 83 and 84 erect. The lower ends of springs 83 and 84 rest on eyelets 92 and 93 on circuit board 33. Circuit board 33 is supported by downwardly extending posts 85, 86 and 87. Posts 85, 86 and 87 are fixed to the under side of top 30 and are molded integral with top 30. The bottom 79 is held on by screws 80 which extend through holes in bottom 79 and are heat riveted to the board 33.

The charger stand 12 has an upwardly standing rim 35 into which the end closure 17 of the light fits when the light is in position for re-charging on the charger. Since the case 11 is square it may be placed on the stand 12 in any of the four positions or any number of positions equal to the number of sides of the case. A three sided light could be put in any of three positions, five positions for a light with a five sided base, any position for a round base, etc. The charger contacts will engage the contacts 28 and 29 on the light properly regardless of the position of the light on the stand so long as the base will fit into the upwardly extending rim 35. The annular terminals 28 and 29 on the light are electrically connected through the lines 49 and 50 to the battery terminals 51 and 52 are connected through lines 53 and 54 to the switch 27 and lamps 21 and 22.

The switch 27 is of the type shown in U.S. Pat. No. 4,383,145 and has an actuator 55 with a metallic movable member 56 attached to it by a rivet 57. The actuator 55 is shown in the intermediate off position 55 indicated in full lines and has a first on positon 55' and a second on position 55''. The plate like member 56 is slideably supported in the recesses under the ribs 59 and 60 which are integral with the sides of the case 11. The member 56 has three metallic fingers 60, 61 and 62. The V-shaped ends of the fingers 60, 61 and 62 slide on insulated surfaces and over holes in the insulated surface 58 to engage wires 65 and 66. One of the battery leads 53 or 54 is connected to the metallic member 63 and the finger 60 connects to one side of the lamps 21 or 22 through the lines 65 and 66 which extend through longitudinal openings in the insulation member 67. Insulation member 67 is supported on the reflector between the lugs 68 and 69.

The case 11 is generally U-shaped and has an open side which is closed by the flood reflector 14. The flood reflector 14 has a longitudinally extending groove which receives the ribs 72 on the sides of the case. The flood lamp 2 has a base that is supported in the boss 73 which is integral with the reflector 14. The flood lammp is connected to the switch elements by lines 74 and 75. The flood reflector 14 is supported on the case 11 by its longitudinally extending edge ribs 76 and 77. The ribs 72 have an enlarged head member on the edge which hold the reflector in place.

The base terminals of the flood lamp 22 are connected to line on 74 and 75 which are in turn connected to the switch. Columns 78 and 79 are integrally attached to the rear side of the reflector and their ends slide between the ribs 90 and 91 on the back of the case 11. The columns 78 and 79 thereby hold the reflector at a fixed distance from the rear of the case 11.

A cord lock device is provided by means of post 96 which is fixed to board 30. Post 96 forces cord 26 to bend into the space between walls 97 and 98 and thus deflect to prevent withdrawal of cord 26 from the stand and thus from sliding.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination a battery and a battery charger,
said battery being disposed in a case,
said case having an inside surface and an outside surface, a central terminal on said case on said inside surface thereof, an annular terminal on said case on said outside surface, said battery having a first battery terminal and a second battery terminal, means connecting said first battery terminal to said central terminal and means connecting said annular terminal to said second battery terminal, said battery charger having charging means thereon, a first charge terminal on said charger, a second charger terminal on said charger spaced from said first charger terminal, means to position said case on said charger over said charger terminals, said first charger terminal being adapted to engage said central terminal on said case, and said second charger terminal being adapted to engage said annular terminal on said case, said charger has two spaced members thereon, a cover means to attached said cover to said charger, said cover having a post thereon adapted to enter the space between said spaced members to deform said cord whereby said cord is held against withdrawal from said charger, a piece of foam plastic is provided, said foam plastic having two sides spaced from one another, pressure sensative adhesive on each of said two sides, said battery engaging one side of said foam plastic, the other side of said foam plastic engaging said light whereby said battery is held in place in said light by said pressure sensative adhesive.

2. In combination a light having a battery and a charger, said battery comprising a lamp having a case and a lamp circuit, a battery, said case comprising a support surface area, a first terminal on said support surface area, non-circular in cross section, an annular terminal on said support surface area, a battery charger stand, said stand having a charging means thereof adapted to provide a charging current to the battery, support means on said stand adapted to have said surface area supported thereon, first terminal on said stand, a second terminal means on said stand spaced from said first terminal means and adapted to engage said annular terminal on said case, said first terminal means on said stand being adapted to engage said first terminal on said surface area whereby said charging means is connected to said battery, said surface area on said case is non-circular in cross section, said lamp has an end member, said surface area being on said end member, said end member has a shape complimentary to the shape of said stand and is adapted to be supported on said stand in a plurality of relative positions of rotation, and guide means on said stand to guide said lamp into one of said plurality of positions, said guide means on said stand comprises a rim extending upwardly from said support means on said stand and adapted to receive said end member of said body, said restore circuit including a switch adapted to connect said restore circuit in paralled with said charging terminals when said battery is connected to said circuit to impress a restore charge voltage on said battery for charging, said switch being adapted to switch said restore voltage away from said battery to connect a voltage lower than said restore charging voltage

3. The combination recited in claim 2 wherein said charging means comprises a circuit board, a first end of helical springs are supported on said circuit board in engagement with said circuit.

4. The combination recited in claim 2 wherein said stand has a bottom, a circuit board is supported in said stand generally parallel to said bottom and spaced therefrom.

5. In combination, a battery charger stand and an electrical device having a rechargeable battery, said electrical device having a case and an electrical circuit and including said rechargeable battery connected to said circuit, a support side on said case, said support side having an inside surface and an outside surface, a central opening in said support side, a first device terminal on said case, said first device terminal comprising a metallic central contact member on said inside surface of said supporting side, means connecting said central contact member to one said terminal of said battery, a second device terminal on said outside surface, said second device terminal comprising an annular flat plate like member attached to said outside surface of said case, a hole in said support side disposed generally concentric to said first device terminal, said device terminal overlying said hole, said support surface being adapted to rest on said support surface of said battery charger, said battery charger having a first contact member and a second charger contact member, said first charger contact member being adapted to engage said first device terminal, a second charger terminal being adapted to engage said second device terminal whereby said charger circuit is connected to said battery in any position of orientation of said device relative to said charger, said first terminal and said second terminal being adapted to be engaged by a first charger terminal and the second charger terminal, a charger stand having a support surface adapted to support said light, said charger terminals being disposed on said support surface on said charger stand whereby said light can be supported on said charger stand with said first terminal and said second terminal on said charger stand in engagement with said first terminal and said second terminal on said light, said first charger means comprises a printed circuit board, said printed circuit board being supported in said stand in a plane generally parallel to said supporting surface, first contact means on said printed circuit board, second contact means on said support member, said first contact means comprising a helical spring resting on said first contact means and engaging said second contact means.

6. The combination recited in claim 5 wherein said annular metallic member is generally flush with said flat bottom surface of said body.

7. The combination recited in claim 6 wherein said supporting surface has a switch recess therein, a second switch disposed in said recess, said second switch being connected to said charger means whereby a normal charging voltage can be applied to said battery when said second switch is in a first position and a higher than normal voltage can be applied to said battery when said second switch is in a second position.

8. The combination recited in claim 7 wherein said stand has lugs on one side thereof in the form of downwardly facing hooks for supporting said stand on a vertical surface.

9. The combination recited in claim 8 wherein said battery case is square in cross section.

* * * * *